United States Patent [19]

Hicks

[11] Patent Number: 4,660,757

[45] Date of Patent: Apr. 28, 1987

[54] DUAL ACCESS NEWSPAPER RECEPTACLE

[75] Inventor: Robert R. Hicks, Wauseon, Ohio

[73] Assignee: James E. Barber, Wauseon, Ohio

[21] Appl. No.: 719,571

[22] Filed: Apr. 3, 1985

[51] Int. Cl.[4] ..... A47G 29/12

[52] U.S. Cl. ..... 232/1 C; 232/17; 232/43.4

[58] Field of Search ..... 232/17, 19, 20, 27, 232/38, 43.4, 43.1, 1 C, 45, 47, 48; 220/340, 343, 326

[56] References Cited

U.S. PATENT DOCUMENTS

| | | | |
|---|---|---|---|
| 1,387,794 | 8/1921 | Mantel | 220/343 |
| 3,106,335 | 10/1963 | Allen | 232/17 |
| 3,680,773 | 8/1972 | Thompson | 232/17 |
| 3,942,715 | 3/1976 | Anderson | 232/17 |
| 4,005,816 | 2/1977 | Malik | 232/17 |
| 4,220,278 | 9/1980 | Hasselbring | 232/17 |
| 4,413,770 | 11/1983 | Nye | 232/17 |
| 4,508,259 | 4/1985 | Hicks | 232/17 |

*Primary Examiner*—Gene Mancene
*Assistant Examiner*—John G. Weiss
*Attorney, Agent, or Firm*—George R. Royer

[57] ABSTRACT

The subject invention is a dual access newspaper receptacle which is based, in general, on a longitudinal box member with an internal hollow chamber, wherein such chambered box has two entry accesses to the hollow chamber in box. One entranceway has a hinged door for insertion of newspapers or the like from the front of the box, with a second access door on either the sides, back, or front of mailbox for removing the contents from such box as appropriate.

1 Claim, 6 Drawing Figures

DUAL ACCESS NEWSPAPER RECEPTACLE

DISCUSSION OF PRIOR ART AND BACKGROUND OF INVENTION

The main application of the device incorporating the subject invention is for housing newspaper or similar matter on a temporary basis. Other pertinent applications comprise drop boxes, wherein one must take out the contents after a deposit-drop therein of specific articles. The device incorporating the subject invention additionally possesses other uses such as used for temporary storage of items intended for subsequent withdrawal. In this regard, while the main application of this invention is directed to the construction of off-road receptacles for newspapers used primarily in rural or suburban areas, substantially similar other types of devices can utilize the principles thereof.

The type of newspaper receptacles of the type used primarily in rural or suburban areas differ substantially from those in older urban areas. Specifically, in suburban areas of moderate or large-sized cities, newspaper receptacles are usually appended directly to a dwelling, or mailboxes are used, and as such they are generally offset from the road, generally distal from the roadway on which the dwelling is located. On the other hand, newspaper receptacles used in rural areas and suburban areas are usually affixed above the ground on a vertical post positioned adjacent the road, comprising a hollow cylinder, with one end open. In this regard, the newspaper box entranceway is almost always faced towards the doorway. Usually the entranceway is emplaced extremely close to the edge of the roadway travelled by the delivery vehicle so that the deliverer can easily place the newspaper in the box. Frequently, the adjacent roadway is a heavily-traversed throughfare, with vehicles passing at moderate to high speeds a relatively few feet from the receptacle entrance door. One can readily ascertain the relative danger to the patron by the proximity of the mailbox to the roadway traffic, in view of the fact that the user must step close to the roadway traffice in order to extract the newspaper from the receptacle. As can be seen, the potential for vehicular-pedestrian mishaps is substantial under such circumstances, and the threat of serious injury is a very real danger. The danger lies in the fact that the patron, who seeks to extract the newspaper from the receptacle must step in front of the box to open the doorway and pull the paper out accordingly. This process usually entails the need to stand in front of the receptacle or close thereto. Such a feature clearly presents a potential danger by reason of the close proximity to the roadway and the traffic thereon.

This invention is directed as a means to overcome the foregoing problems and devise a receptacle which avoids or aleviates, to a substantial degree, the potential for highway accidents involving persons who are extracting newspapers from a receptacle. The following objects of the invention are directed accordingly.

OBJECTS

It is an object of the subject invention to provide an efficient newspaper or parcel receptacle;

Another object of the invention is to yield a newspaper receptacle which is safe to use;

Yet another object of the invention is to provide a receptacle which is safe to use in the process of placing or removing the contents therefrom;

Another object of the subject invention is to provide an improved newspaper receptacle;

Still another object of the subject invention is to provide an improved object receptacle of the type used closed to highways;

Another object of the subject invention is to provide a multiple or variable access newspaper receptacle, having two or more entrances;

Still another object of the subject invention is to provide an improved newspaper receptacle with dual entrance means;

An object of the subject invention is to provide a receptacle which alleviates highway safety problems;

Other and further objects of the subject invention will become apparent from a reading of the following description taken in conjunction with the drawings.

DRAWINGS

DESCRIPTION OF GENERAL EMBODIMENT

The invention herein is a newspaper or similar parcel receptor box, which is constructed to have means to avoid the necessity of having the user stand in front of the receptacle and open the door thereof, near a roadway, in order to place therein or remove newspaper or other contents. In its most general form, the subject invention has a secondary entranceway or doorway by which one can extract the contents, or emplace newspaper, etc., therein without the need of standing in front of the doorway by the road edge.

DESCRIPTION OF PREFERRED EMBODIMENT

Turning now to the drawings which show a preferred embodiment of the subject invention herein. Particular attention is directed first to FIG. 1. In the process of describing the invention herein, it is to be stressed that the word "frontal" will be employed in reference to those parts of the receptacle which are oriented towards or facing towards the roadway, while the nomenclature "rear" or "poterior" will be employed in regard to those portions of the receptacle which are directed generally away from the roadway, away from the front entrance. Additionally, it is to be indicated that in describing the subject invention, the following will be centered on a limited embodiment, however such a description cannot be considered as limiting the scope of the invention as set forth in the claims.

Figure 1:
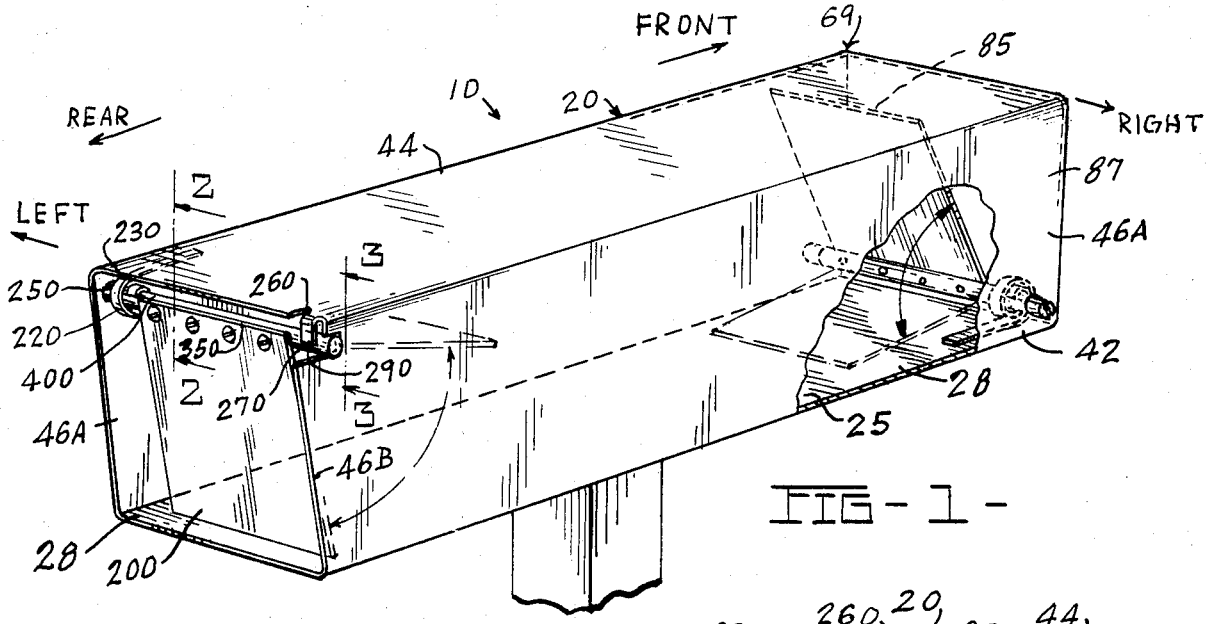
FIG. 1 is a perspective view of the subject invention shown partially cut away.

In FIG. 1, a hollow newspaper box 10 is set forth, which box 10 possesses certain limited features of the conventionally structured newspaper receptacle, as seen on rural or suburban delivery routes. Specifically, box 10 comprises a longitudinally extending housing member 20, the interior chamber 25 of which is hollowed or open in order to receive newspapers or other contents therein in a conventional manner. In general, the interior chamber 25 of the box 20 is of a longitudinal dispostion generally conforming to the exterior configuration of the housing 20, however, this latter aspect is not critical to the utility of the housing 20 so long as there is a longitudinal chamber on the inside to receive a newspaper, usually folded in somewhat of a longitudinally extending manner.

The interior chamber 25 of the housing 20 has a floor 28, with a solid roof 44 to cover the inside chamber to protect same from adverse climatology. Internal vertical and laterally disposed sidewalls 46A and 46B join the roof 44 with the floor 28 in the housing 20. Disposed on the frontal end 69 of the housing 20 is a pivotable door 85 which is structured to conform to the shape of the front entranceway 87. Front door 85 is pivotally mounted on its lower extreme to the floor of housing 20, as shown in FIG. 1. Specifically, shown in FIG. 1, such front door 85 is integrally hinged to the lower inside surface 42 of the housing 20 as specifically represented in FIG. 1.

As can be seen, the front door 85 is adapted to be pivotally moved from the vertical position, pivotally moving to the downward horizontal position shown in FIG. 1. This latter movement is a functional feature of the pivot member being disposed on the bottom floor 44 of the box 20. Since the pivotable mechanism on the front door is identical in its pivotal structure to the rear door, except for the rear door having a pivotal mechanism on its upper edge, this description will be made of the rear door pivotal mechanism only. Disposed on the rear portion of the housing 20 is the rear entrance door 200 which is integrally hinged to the upper surface of said housing in a manner similar to the front door but, as stated, the rear door is pivotally mounted to the upper inside of the box, as shown. Since, the front door 85 and rear door 200 are similar in construction and method of attachment to the housing 20, except for the location of the pivotal connection, the following description will be directed to the rear door 200, with the understanding that the structural principles for the rear door will apply to the front door assembly, except as stated.

As seen in the drawings, the hinge assembly 220 for the rear door is integrated into the upper rear roof 44 of housing 20, as shown. More specifically, the hinge assembly 220 is on the upper rear edge 230 of the housing 20.

Figure 3:
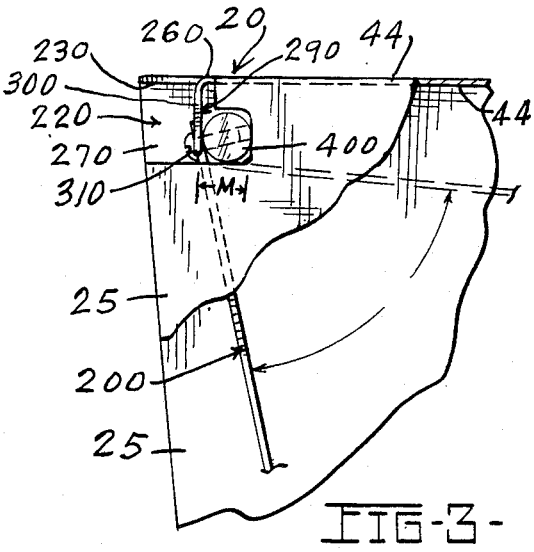
FIG. 3 is a side elevational view of the subject invention, shown partially in section.

The pivotal connecting assembly for the rear door assembly is structured as described below. Machined with the left vertical wall 46A, near the upper part thereof, just beneath roof 44, is a circular bore 250, adapted to rotatably hold a longitudinal circular shaft member, as more fully described below. In the upper right corner 260 of the vertical wall 46B of the housing 20, there is formed an L-shaped cut 270, as seen from a side cross-sectional view as seen in FIGS. 1 and 3.

In such rear right corner section 260 of the roof structure 44 is formed a depending leg 290, as shown in the drawings, which leg is formed by cutting a rectangular section 300, the longitudinal axis of which is parallel to the longitudinal axis of the box 20, and then turning down the rectangular section 300 so that it depends vertically downwardly, as shown, in the corner section 260. The bottom end 310, of the leg 300 projects vertically downwardly into the L-shaped cut, approximately about one-half the distance with such cut. Moreover, a clearance distance M is left between the rear portion of the L-shaped cut 260, as shown.

Figure 2:
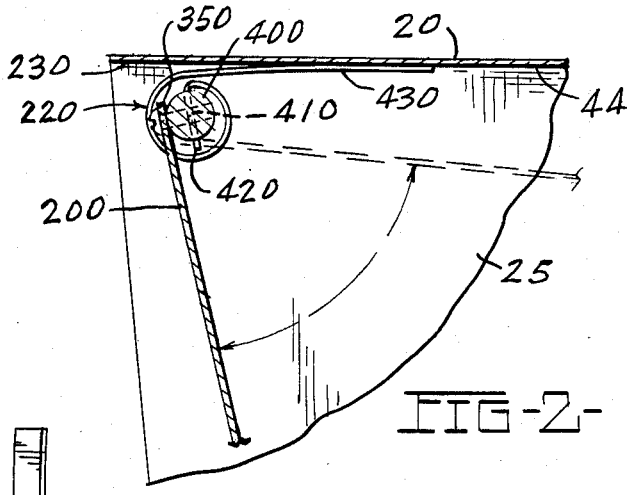
FIG. 2 is a side elevational view of the subject invention, shown partially in section.

The rectangular shaped doorway 200 is integrally affixed to a longitudinally extending rod member 400 of circular cross-sectional configuration, as seen. More specifically, the upper edge of door 200 is either welded, screwed onto, or otherwise affixed in tangential fashion to the periphery of the rod 400, as shown in FIGS. 2 and 3. As a result, the linear upper edge 350 of the door 200 and the rod member 400 become aligned along one another in the juxtaposed relationship shown and described.

Figure 4:
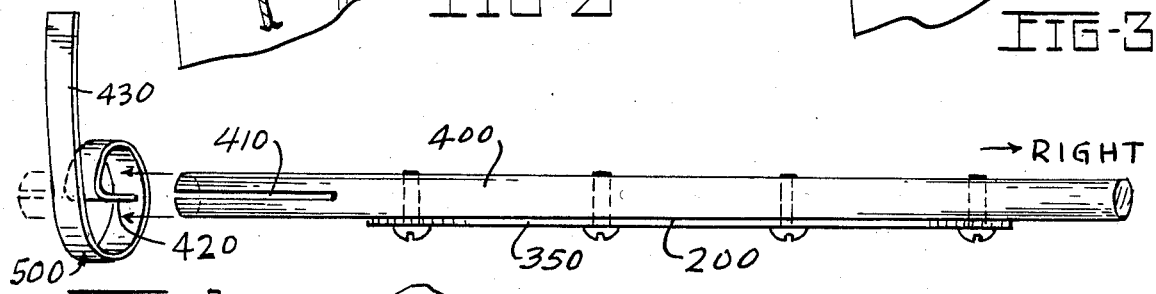
FIG. 4 is an elevational view of the door attachment device.
Figure 5:
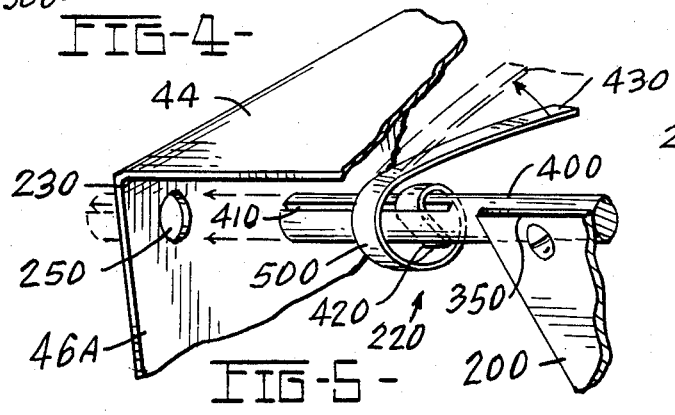
FIG. 5 is a perspective view of the door attachment mechanism.

The linear rod member 400 can be machined with appropriate screw holes to receive screws for attachment of the doorway to the upper portion, as shown. The extreme left end of rod 400, as shown in FIG. 4, is formed with a longitudinally extension slit member 410, such slit member 410 being adapted to securely receive the inner leaf 420 of a coil spring member 500, as shown in FIGS. 4 and 5. The outer leaf 430 of the spring 500 is integrally affixed by welding same to the roof 44, as shown in FIG. 3 once the circular bar 400 is emplaced as described below.

Once the door 200 is attached to the bar 400 as shown, the left end of the bar 400 is inserted into opening 250 for free rotation therein, while the outer leaf 430 of the coil spring 500 is affixed in a flush manner to the wall 44, as shown. This coil spring 500 serves to bias the door from completely free movement when it is moved inwardly, as shown in FIGS. 2 and 3.

Figure 6:
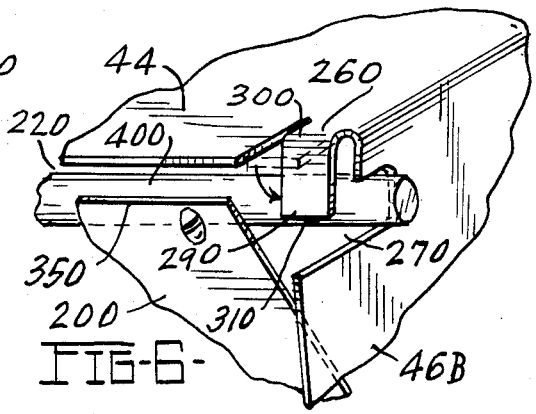
FIG. 6 is a perspective view of the door attachment mechanism.

The right side of bar 400 is positioned in the space M in the L-shaped cut 270 behind the vertical leg 300, as shown in FIG. 6. This latter aspect serves to retain the bar 400 in position aligned along the rear upper edge 230. In this latter relationship the door 200 is free to pivot inwardly from the upper position when one wishes to withdraw a newspaper from the box 20 after it is inserted through the front door 85.

While a preferred embodiment of the subject invention has been shown, it shall not be considered as limiting the scope of the subject claims.

I claim:

1. A receptacle for newspapers with a frontal end and a back end for receiving and holding newspaper materials for storage and withdrawal of such materials from said receptacle comprising:

(a) a hollow housing member having a hollow inner chamber having a frontal end and a back end, said receptacle having a front doorway on the frontal end of said housing, and a back doorway on the back end of said housing member, said housing member having an inner upper surface and a lower inner surface in the hollow inner chamber, with laterally disposed first and second vertical sidewalls, said housing member having a circular opening in the first vertical sidewall and said housing having an L-shaped opening in the second vertical sidewall, said L-shaped opening being open to the back edge of said second vertical sidewall and partially enclosed relative to said back vertical edge by a leg projecting vertically downwardly into the rear portion of said L-shaped opening.

(b) first pivot means disposed on the back end of the inner upper surface of said housing member, said pivot means comprising a longitudinally extending bar member rotatably mounted in the back portions of each of the first and second vertical sidewalls;

(c) doorway means having an upper portion and lower portion, which upper portion is affixed to said first pivot means on the upper portion of the back doorway;

(d) second pivot means on the front end of the lower inner surface of said housing, said second pivot means comprising a longitudinally extending bar member, having a first end and a second end, rotatably mounted to the front portion of each of the laterally disposed first and second vertical sidewalls with the first end of said bar member being fitted through the circular opening in the first vertical sidewall and the second end of said bar member being fitted through a portion of said L-shaped opening in said second vertical sidewall, said second pivot means being affixed to the lower portion of the front doorway;

(e) spring means mounted to said pivot means to restrain movement of said doorway means.

* * * * *